US006497629B2

(12) United States Patent
Takeda

(10) Patent No.: US 6,497,629 B2
(45) Date of Patent: Dec. 24, 2002

(54) GOLFING IRON CLUB AND MANUFACTURING METHOD THEREOF

(75) Inventor: Hitoshi Takeda, Tsubame (JP)

(73) Assignee: K.K. Endo Seisakusho, Niigata-ken (JP)

( * ) Notice: Subject to any disclaimer, the term of this patent is extended or adjusted under 35 U.S.C. 154(b) by 19 days.

(21) Appl. No.: 09/909,324

(22) Filed: Jul. 19, 2001

(65) Prior Publication Data

US 2002/0016218 A1 Feb. 7, 2002

Related U.S. Application Data

(63) Continuation-in-part of application No. 09/366,582, filed on Aug. 4, 1999, now abandoned.

(30) Foreign Application Priority Data

Mar. 24, 1999 (JP) ..... 11-80549
Jul. 22, 1999 (JP) ..... 11-208209

(51) Int. Cl.[7] ..... A63B 53/04; A63B 53/06; A63B 53/08; B23P 13/04

(52) U.S. Cl. ..... 473/324; 473/349; 473/350; 473/409; 29/558; 29/557

(58) Field of Search ..... 473/324, 350, 473/379, 409; 72/341, 377; 29/557, 558

(56) References Cited

U.S. PATENT DOCUMENTS 5,415,834 A * 5/1995 Finkl et al. ..... 420/109
5,930,887 A * 8/1999 Tomita et al. ..... 29/527.1
6,030,295 A * 2/2000 Takeda ..... 473/345

* cited by examiner

*Primary Examiner*—Paul T. Sewell
*Assistant Examiner*—Sneh Varma
(74) *Attorney, Agent, or Firm*—Quarles & Brady LLP

(57) ABSTRACT

A manufacturing method for a golfing iron club and an iron golf club manufactured by the method. A shaft is connected to a head 1 having a face 3 on a front and a shaft attachment portion on one side. After a pre-forging stage using an upper die and a lower die, a rear region corresponding section 9'A and a lower peripheral face corresponding section 11A are machined with an end mill A. Then post-forging is performed using an upper die and a lower die to form the head 1. Thereafter, post-machining is performed using an end mill B. Thus, a rear region 9A and a lower peripheral face 11 can be formed without forging. Machining can be carried out between the pre-forging and post-forging stages, so that locations which are difficult to forge can be accurately formed. In addition, the head 1 is able to be formed more freely, owing to a post-machining stage.

16 Claims, 10 Drawing Sheets

GOLFING IRON CLUB AND MANUFACTURING METHOD THEREOF

CROSS REFERENCE TO RELATED APPLICATIONS

This is a continuation-in-part application of U.S. Ser. No. 09/366,582 filed on Aug. 4, 1999, now abandoned.

BACKGROUND OF THE INVENTION

1. Field of the Invention

The present invention relates to a golfing iron club having a shaft attached to a head formed by forging and provided with a face on a front surface and a shaft connecting portion on one side, and a manufacturing method thereof.

2. Description of the Related Art

Golf clubs which comprise a head and a shaft, are generally classified as one of three types: a wood, an iron, or a putter. Irons are classified by the loft angle of their head. Irons with a small loft angle (for example, from 20 to 30 degrees) are called "long irons", while irons with a large loft angle (for example, from 40 to 50 degrees) are called "short irons". Normally, irons are numbered in ascending order from longest to shortest, for example, Nos. 1, 2, 3, 4, 5, 6, 7, 8, 9 and PW (pitching wedge).

The head of an iron club may have a concave back (a cavity-back iron) on the rear of the face which is the front of the head for hitting golf balls, or may have a smooth back (a solid-back iron). The front has an area known by such names as "the sweet spot".

When manufacturing the aforementioned head, the usual method, for reasons of strength, is forging. The material conventionally used for the head is soft iron. After forging the soft iron to form the head piece, the head is subject to heat treatment and other processing followed by surface polishing, etc., until the final product is formed.

To realize high strength however, soft iron has recently begun to be replaced by high-strength metals such as stainless steel, titanium alloys, and nickel alloys. At the same time, because of improvements with dies, the shape of cavity-back forged heads of irons has been changing from a comparatively small and flat cavity base area, to a range of designs such as a large cavity base area with an irregular surface, while a deeply gouged design known as an "under cut" is also used.

Although high-strength metals can be used to manufacture superior heads, they have a drawback. High-strength metals offer high strength even at high temperatures but with little ductility. When such high-strength metal heads with large and deep cavities and in various designs are forged, the metal does not expand sufficiently to achieve the desired shape, resulting in underfill. If efforts are made to force the desired shape, then fracturing or deformation occur.

Thus, with conventional manufacture by forging, forging processes such as rolling, preforming, intermediate forming and finishing, are implemented gradually to form the head. However, forming the head exclusively by forging processes using dies results in fracturing and other problems during forging, and not only is the number of processing stages increased but also die costs and other costs rise. In the manufacture of the abovementioned cavity-back iron head in particular, the cavity-back iron head can be formed into roughly the same shape as the abovementioned solid-back by forging, and subsequent machining can create the cavity portion, but this method includes such problems as substantial materials wastage, and further machining stages to finish the head to a complex shape.

SUMMARY OF THE INVENTION

The present invention address the above-mentioned problems, with the object of providing a method of manufacturing a golfing iron club with a head of metal material, where the head is formed precisely and inexpensively.

According to a first aspect of the present invention there is provided a method of manufacturing a golfing iron club having a shaft attached to a head formed by forging and provided with a face on a front surface, a cavity in a rear surface, and a shaft connecting portion on one side, which comprises the steps of: forming a raw material of the head, selected from among stainless steel, titanium alloy, nickel alloy and high tensile strength steel, into a head piece so that the head piece may be provided with respective parts corresponding to said face, shaft connecting portion and cavity, by a first die forging step; forming a lower peripheral face of the part corresponding to said cavity, by a first machining step, while cutting off flash formed during the first die forging step; forming the head piece into said head, by a second die forging step; and forming the lower peripheral face of the part corresponding to said cavity to an undercut shape.

With the construction of the first aspect, the head may be formed by machining between the pre- and post-forging stages, whereby even though a high strength metallic material is used, there can be provided a golfing iron club whose head has a wide and deep cavity with various and complicated designs, and yet is formed precisely and inexpensively. Further, although the configuration of flash varies per respective products, the post-forging, i.e., the second forging step can be performed precisely without being affected by the flash, due to the flash being cut off prior to the post-forging step.

According to another aspect of the present invention there is provided a method of manufacturing a golfing iron club according to the foregoing aspect, wherein said first and second machining steps use an end mill as a machining tool, in which an end mill of a smaller diameter is used in said second machining step than in said first machining step.

With the end mill of a smaller diameter used for the post-machining, more precise processing is possible, thus obtaining a finish with more precisely adjusted distribution of weight.

The invention is also addressed to a golfing iron club manufactured by the methods.

Other objects, features and advantages of the invention will become apparent to those skilled in the art, from the following description of the preferred embodiments of the invention, wherein reference is made to the accompanying drawings, in which:

DESCRIPTION OF THE PREFERRED EMBODIMENTS

Figure 9:
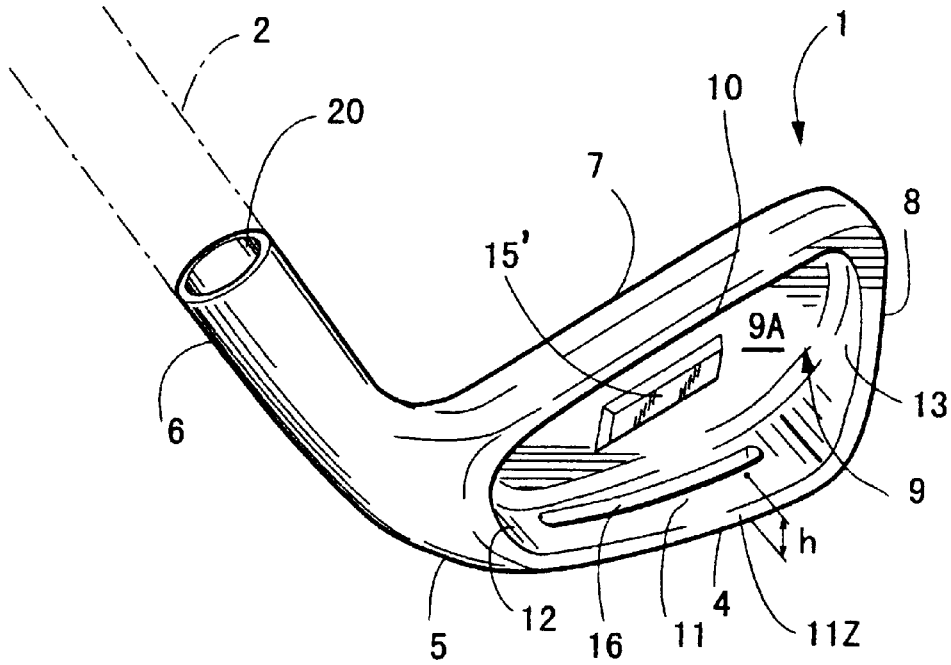
FIG. 9 is a perspective view of a final product illustrating an embodiment of the invention.
Figure 10:
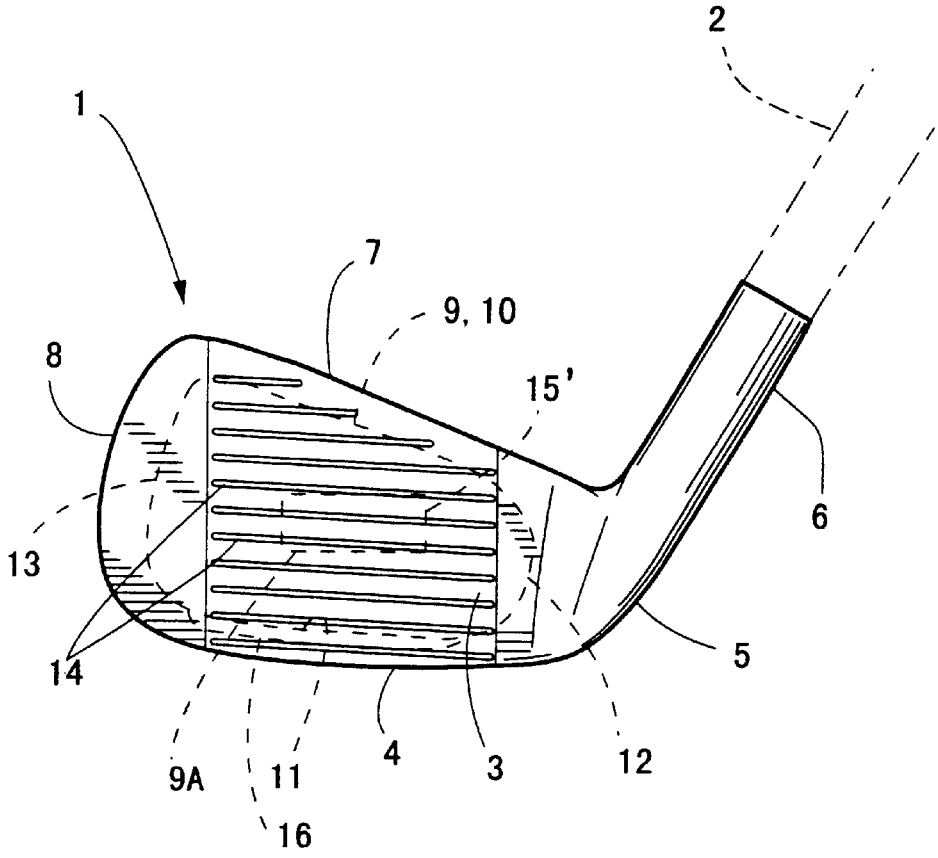
FIG. 10 is a front view of the final product illustrating an embodiment of the invention.

As follows is a description of embodiments of the present invention with reference to the appended drawings. As shown in FIG. 9 and FIG. 10, a golfing iron club comprises a head 1 and a shaft 2. The head 1 is made of a high-strength metal such as stainless steel, titanium alloy, nickel alloy, or high tensile strength steel, and is provided on a front surface with a face 3 for striking a ball, on a bottom portion with a sole 4, and on one side with a heel 5. Moreover the head is respectively formed, on an upper portion of the heel 5 with a shaft connecting portion 6 for connecting the shaft 2, on an upper portion with a top 7, and on an other side with a toe 8. In addition, on the rear side of the head 1 are formed such parts as a cavity portion 9, located substantially opposite to the face 3. The cavity portion 9 is formed with an upper peripheral face 10 on an inside top portion of an inside rear region 9A, a lower peripheral face 11 on an inside bottom portion with a sole 4 of thickness h, and one side peripheral face 12 and an other side peripheral face 13 on one side and the other side of the inside respectively. Numeral 14 shown in FIG. 10 designates horizontal grooves formed on the face 3, which are called score lines. Further, as shown in FIG. 9, the center of the inside rear region 9A is formed with a small protrusion 15' which extends sideways for improving the attractiveness of design. Also, a groove 16 is formed near the inside rear region 9A on the lower peripheral face 11, said groove 16 extending from the one side peripheral face 12 to the other side peripheral face 13.

Figure 1:
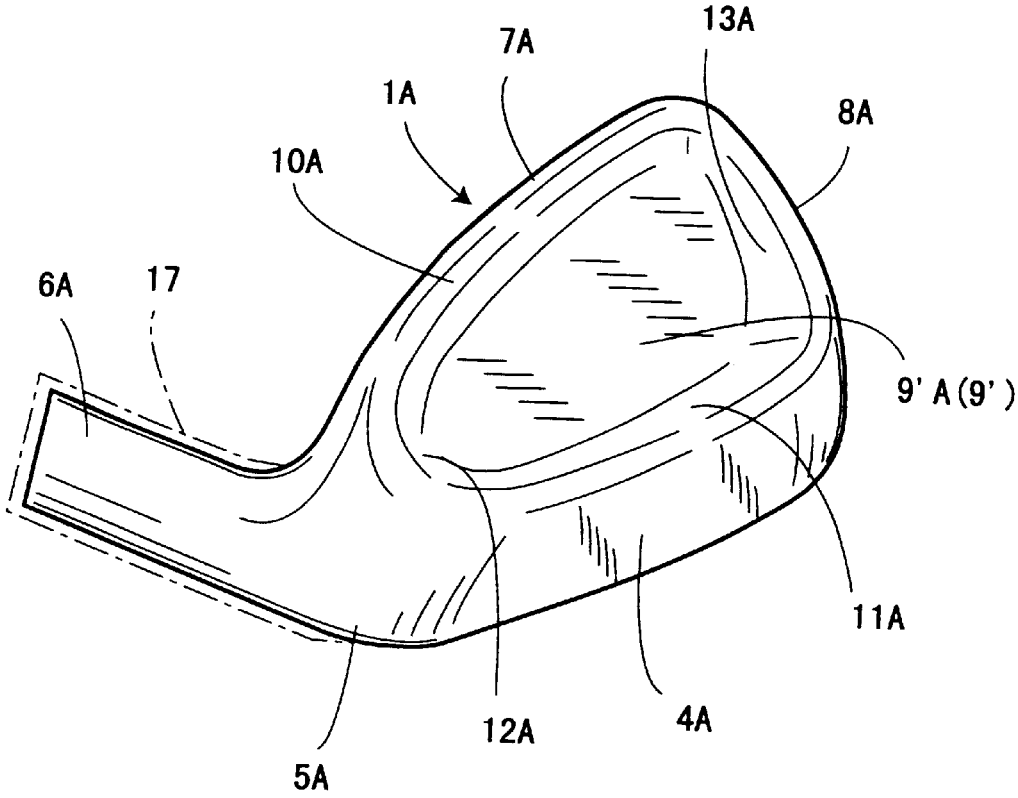
FIG. 1 is a perspective view of a pre-forging stage illustrating an embodiment of the invention.
Figure 2:
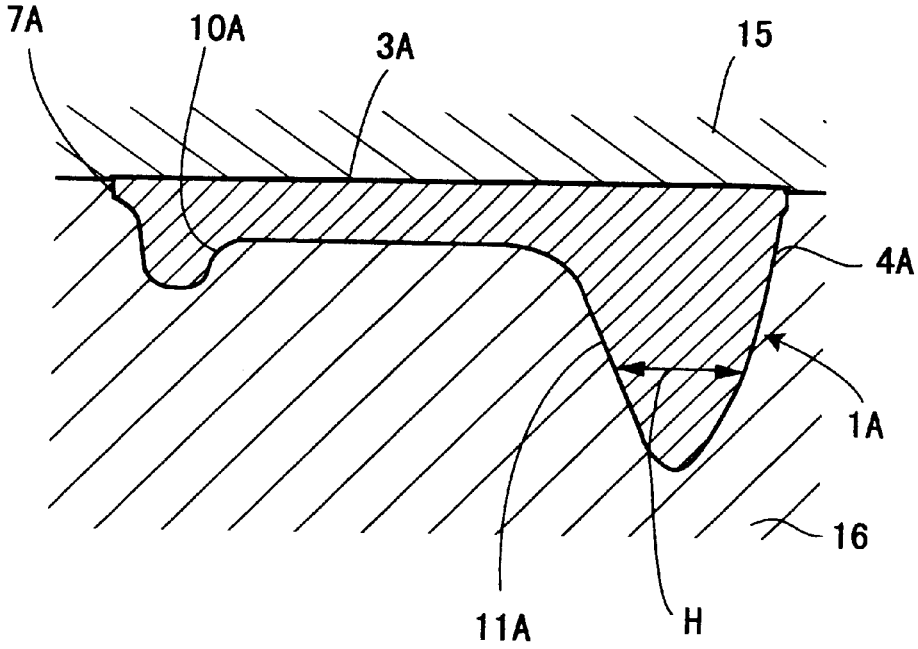
FIG. 2 is a cross-sectional view of the pre-forging stage illustrating an embodiment of the invention.
Figure 3:
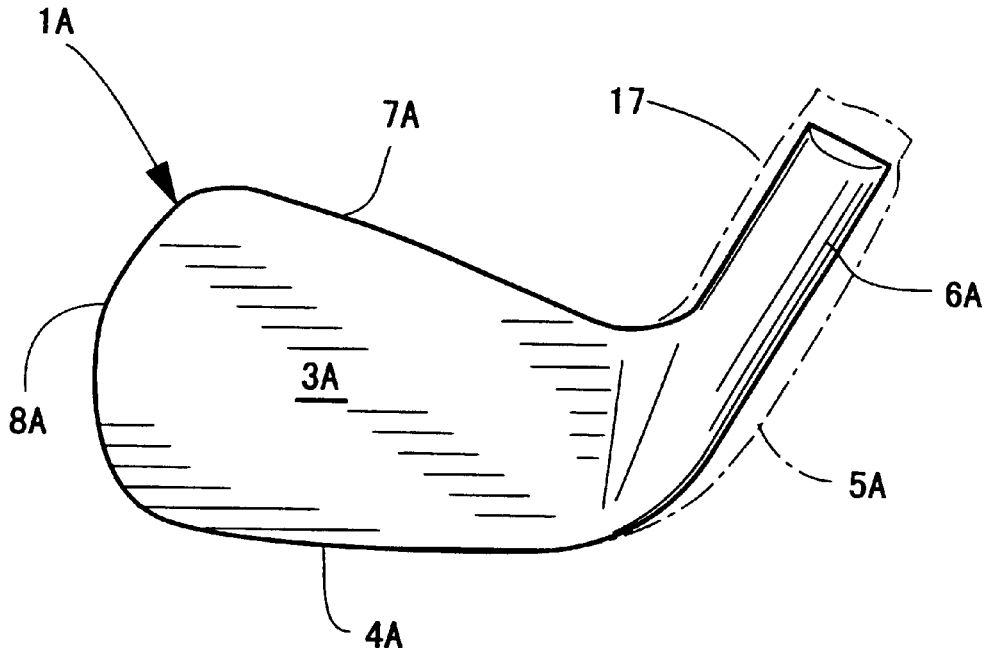
FIG. 3 is a front view of the pre-forging stage illustrating an embodiment of the invention.

Next is a description of the method of manufacturing the head 1. In the raw materials processing stage, a round bar made out of the high-strength metal material (not shown in the Figures) is cut off to the desired length to form the head. Next, the raw material is pre-forged as shown in FIG. 1 through FIG. 3 to form a head piece 1A. What is meant by "pre-forging" here is to preliminarily forge a raw material. The details of this pre-forging process involve roll forging, then preforming and intermediate forming using one die or an upper die 15 and the other die or a lower die 16, to gradually draw out the raw material. Further, reference numeral 17 denotes a flash formed during the forging. In this pre-forging stage, processing the raw material by forging forms a face corresponding section 3A, a sole corresponding section 4A, a heel corresponding section 5A, a shaft connecting portion corresponding section 6A, a top corresponding section 7A, a toe corresponding section 8A, and a cavity corresponding section 9', which correspond respectively to the face 3 of the completed head 1, the sole 4, the heel 5, the shaft connecting portion 6, the top 7, the toe 8, and the cavity portion 9. The cavity portion corresponding section 9' is formed with an upper peripheral face corresponding section 10A on an inside top portion of an inside rear region corresponding section 9'A, a lower peripheral face corresponding section 11A with a sole corresponding section 4A having a thickness H, and on one side and the other side, a one side peripheral face corresponding section 12A and an other side peripheral face corresponding section 13A respectively. The thickness H is larger than the thickness h.

Figure 4:
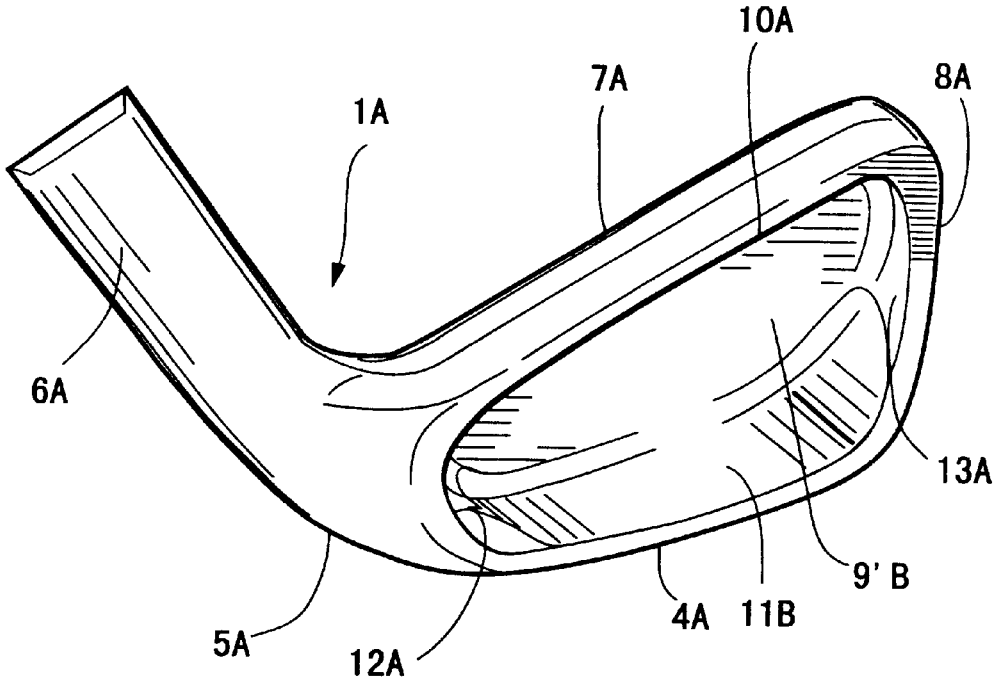
FIG. 4 is a perspective view of a machining stage illustrating an embodiment of the invention.
Figure 5:
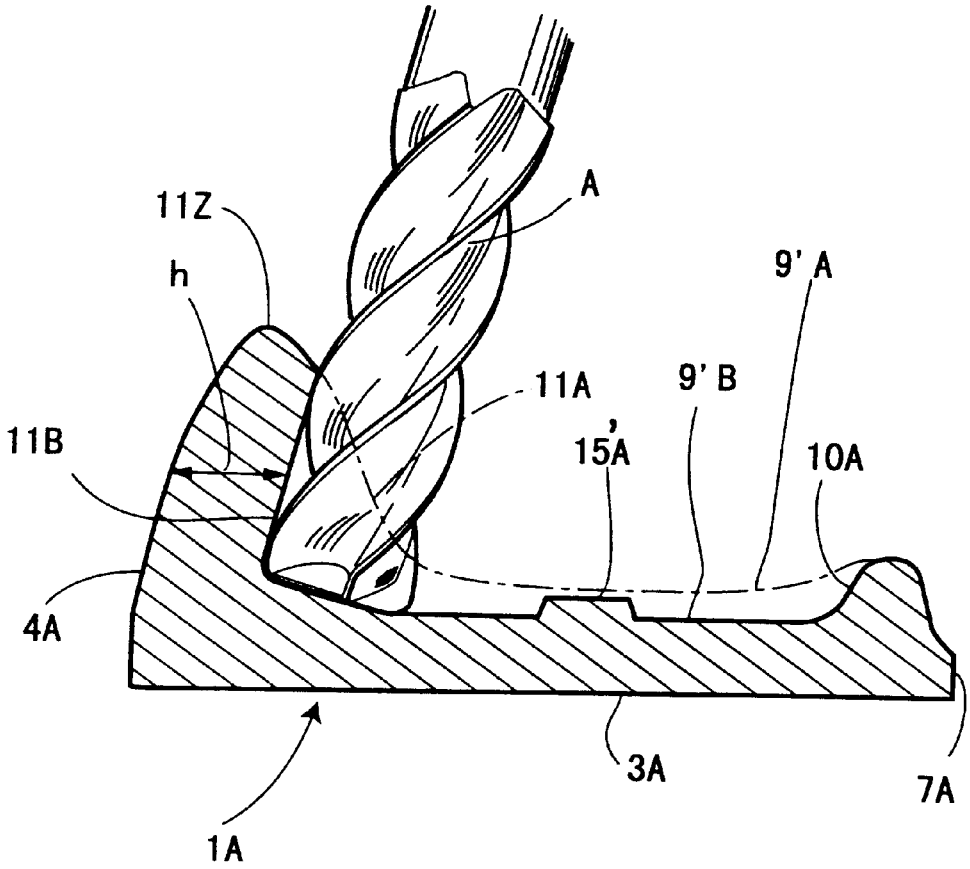
FIG. 5 is a cross-sectional view of the machining stage illustrating an embodiment of the invention.

Next, as shown in FIG. 4 and FIG. 5 the head piece 1A formed by the pre-forging is pre-machined. In detail, this pre-machining involves such processes as machining with a cutting tool, milling, drilling, reaming, broaching, and ultrasonic machining. The actual example shows the case of machining using an end mill A, being a shank-type milling cutter comprising a peripheral face and a cutting blade on its end face. The rear region corresponding section 9'A and the lower peripheral face corresponding section 11A are machined, the rear region machined face 9'B being formed so that the thickness of the face corresponding section 3A is thinned, and the lower peripheral machined face 11B being formed so as to reduce the thickness between itself and the sole corresponding section 4A. This lower peripheral machined face 11B is gouged so as to be formed into undercut shape. In other words, the thickness h between the sole corresponding section 4A and the lower peripheral machined face 11B may be formed substantially the same on a tip end 11Z side and the rear region machined face 9'B side, or otherwise, the thickness h may be formed smaller on the rear region machined face 9'B side than the tip end 11Z side. At the time of this machining stage, the flash 17 is also cut off, while a small protrusion corresponding section 15'A is formed on the inside rear region machined face 9'B.

Figure 6:
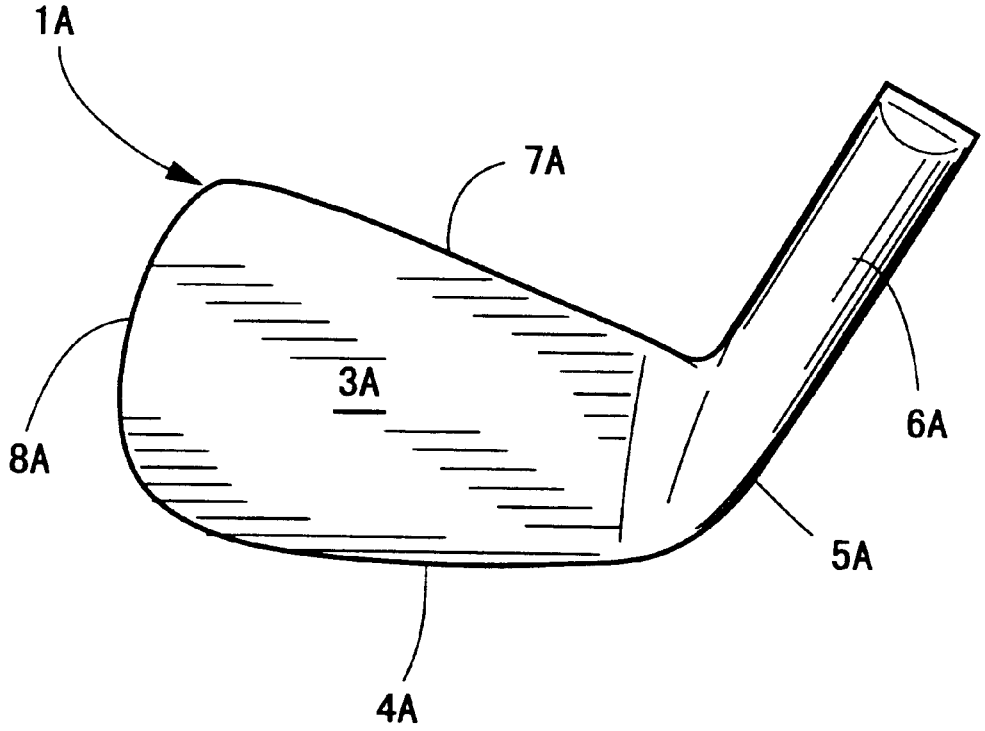
FIG. 6 is a front view of a post-forging stage illustrating an embodiment of the invention.
Figure 7:
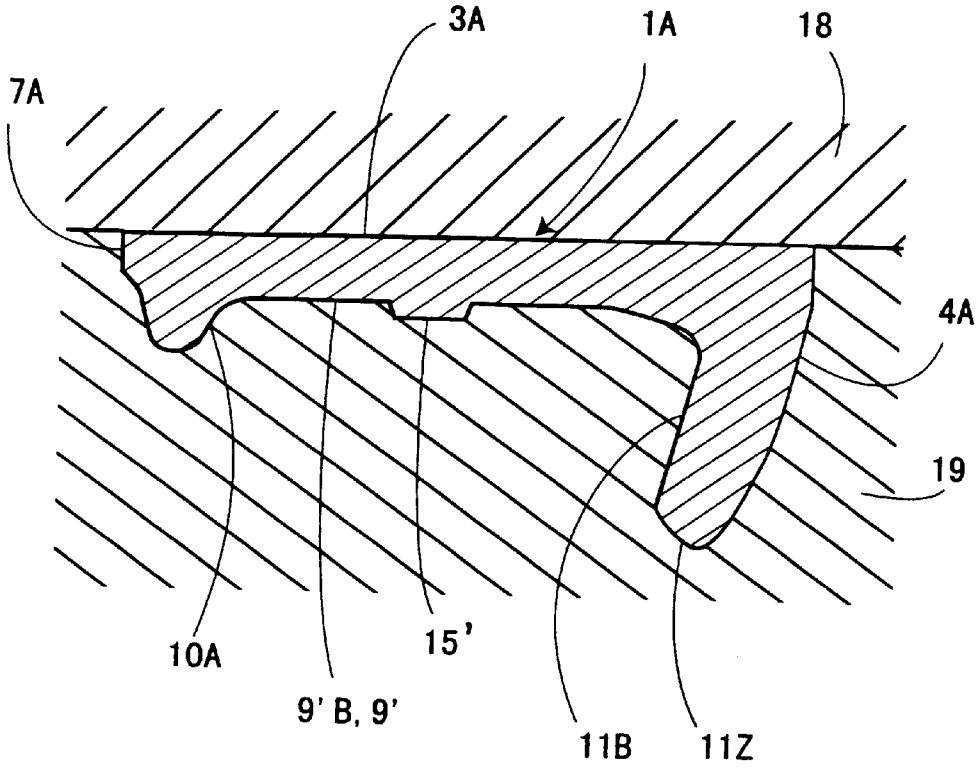
FIG. 7 is a cross-sectional view of a post-forging stage illustrating an embodiment of the invention.
Figure 8:
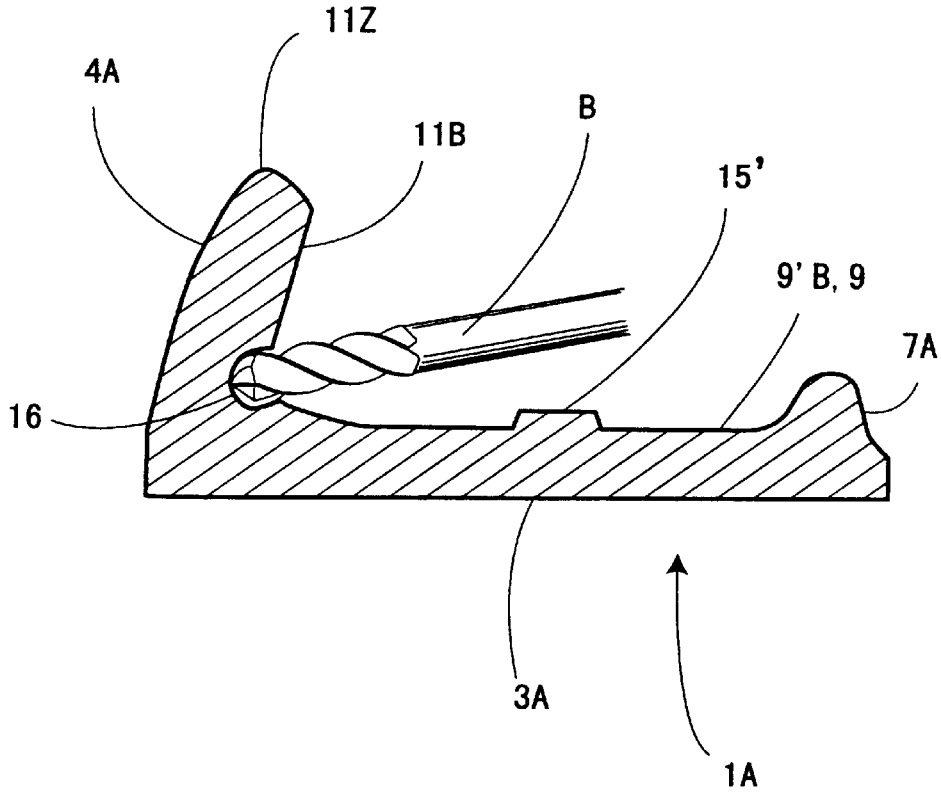
FIG. 8 is a cross-sectional view of the post-machining stage illustrating an embodiment of the invention.

On completion of this machining, the post-forging stage is carried out. What is meant by "post-forging" here is to further forge the aforesaid preliminarily forged material. As shown in FIG. 6 and FIG. 7, the post-forging stage involves, in detail, gradually drawing out the head piece 1A using one die or an upper die 18 and the other die or a lower die 19 to form the head 1. Alternatively, the lower die 19 for this post-forging stage may be a plurality of separate dies combined for that purpose, due to the undercut shape of the deeply gouged lower peripheral machined face 11B.

After thus forming the head 1 by the post-forging stage, the aforesaid groove 16 is formed near the rear region machined face 9'B on the lower peripheral machined face 11B, through the post-machining stage. In detail, this post-machining involves such processes as machining with a cutting tool, milling, drilling, reaming, broaching, and ultrasonic machining. The actual example shows the case of machining using an end mill B, being a shank-type milling cutter comprising a peripheral face and a cutting blade on its end face. The diameter of the end mill B is smaller than that of the end mill A.

Thereafter, the finishing stage is carried out. The finishing stage includes such processes as deburring, surface polishing, forming transverse grooves 14, and forming a hole 20 as shown in FIG. 9 for inserting the bottom end of the shaft 2 into the axial core of the shaft connecting portion 6, and plating.

As above with the embodiment, with the method of manufacturing a golfing iron club having a shaft 2 attached to a head 1 provided with a face 3 formed on a front surface by forging and a shaft connecting portion 6 on one side, after the pre-forging stage using the upper die 15 and the lower die 16, the rear piece corresponding section 9'A and the lower peripheral face corresponding section 11A are machined with the end mill A, and post-forging is then performed using the upper die 18 and the lower die 19 to form the head 1 without forging the rear region 9A or the lower peripheral face 11. Therefore, parts that are difficult to form using dies can be machined between the preforging and post-forging stages to form the parts precisely. In addition, implementing the post-forging stage after the machining ensures grain flow.

Forming the cavity portion 9 by the previously described machining process allows the sections that are hard to process to be reliably and precisely processed. In particular, machining the lower peripheral face 11 of the cavity portion 9 facilitates undercutting and other shaping. Also, machining the rear region 9A allows the thickness of face 3 to be reduced.

Moreover, using the end mill A to perform the machining ensures that the rear piece corresponding section 9'A, and the lower peripheral face corresponding section 11A which are inside of the cavity corresponding section 9', can be formed reliably and accurately.

Also, forming the groove 16, using the end mill B to perform the post-machining of the lower peripheral machined face 11B after the post-forging stage ensures the positioning of the center of gravity of further backwards, thus enlarging sweet spot.

Specifically, even though the material of the head 1 is high strength metal, such as stainless steel, steel, titanium alloy, nickel alloy or high tensile strength steel, the head 1 is able to be formed without restraints, to have for example the aforesaid undercut shape of the lower peripheral face 11 through the pre-forging stage, pre-machining stage and post-forging stage of the invention. In addition, further performing the post-machining stage realizes the further free forming of the head 1, such as the additional forming of the groove 16.

Within the scope of this invention, which is not limited to the above embodiments, various modifications are possible. For example, the upper peripheral face corresponding section 9A of the cavity portion 9, the one side peripheral face corresponding section 12A, and the other side peripheral face corresponding section 13A can all be processed by machining.

What is claimed is:

1. A method of manufacturing a golfing iron club having a shaft attached to a head formed by forging and provided with a face on a front surface, a cavity in a rear surface, and a shaft connecting portion on one side, which comprises the steps of:

forming a raw material of the head, selected from the group consisting of stainless steel, titanium alloy, nickel alloy and high tensile strength steel, into a head piece so that the head piece may be provided with respective parts corresponding to said face, shaft connecting portion and cavity, by a first die forging step;

forming a lower peripheral face of the part corresponding to said cavity, by a first machining step, while cutting off flash formed during the first die forging step; forming the head piece into said head, by a second die forging step; and forming the lower peripheral face of the part corresponding to said cavity to an undercut shape.

2. A method of manufacturing a golfing iron club according to claim 1, wherein the part corresponding to said cavity is machined by a second machining step, after the said second die-forging.

3. A method of manufacturing a golfing iron club according to claim 2, wherein the lower peripheral face of said cavity is formed with a groove by said second machining step.

4. A method of manufacturing a golfing iron club according to claim 3, wherein said groove is formed by abutting a distal end of an end mill to said cavity obliquely relative to said face.

5. A method of manufacturing a golfing iron club according to claim 2, wherein said first and second machining steps use an end mill as a machining tool, in which an end mill of a smaller diameter is used in said second machining step than in said first machining step.

6. A method of manufacturing a golfing iron club according to claim 5, wherein the lower peripheral face of said cavity is formed with a groove by said second machining.

7. A method of manufacturing a golfing iron club according to claim 6, wherein said groove is formed by abutting a distal end of an end mill to said cavity obliquely relative to said face.

8. A method of manufacturing a golfing iron club having a shaft attached to a head formed by forging and provided with a face on a front surface, a cavity in a rear surface, and a shaft connecting portion on one side, wherein a raw material of said head selected from the group consisting of stainless steel, titanium alloy, nickel alloy and high tensile strength steel, is subjected to a first die forging process to form a head piece so that the head piece may be provided with parts corresponding to said face, shaft connecting portion and cavity, and then to a first machining process for forming a lower peripheral face of the part corresponding to said cavity while cutting off flash formed during the first die forging step, and further to a second die forging process for forming the head piece into said head, and forming the lower peripheral face of the part corresponding to said cavity into an undercut shape.

9. A method of manufacturing a golfing iron club according to claim 8, wherein the part corresponding to said cavity is machined by a second machining step, after the said second die-forging.

10. A method according to claim 9, wherein said first and second machining steps use an end mill as a machining tool, in which an end mill of a small diameter is used in said second machining step than in said first machining step.

11. A method according to claim 10, wherein the lower peripheral face of said cavity is formed with a groove by said second machining.

12. A method of manufacturing a golfing iron club according to claim 11, wherein said groove is formed by abutting a distal end of an end mill to said cavity obliquely relative to said face.

13. A method of manufacturing a golfing iron club having a shaft attached to a head formed by forging and provided with a face on a front surface, a cavity in a rear surface, and a shaft connecting portion on one side, which comprises the steps of:

forming a raw material of the head selected from the group consisting of stainless steel, titanium alloy, nickel alloy and high tensile strength steel into a head piece so that the head piece may be provided with respective parts corresponding to said face, shaft connecting portion and cavity, by a first die forging step;

forming a lower peripheral face of the part corresponding to said cavity into an undercut shape, using an end mill with a distal end abutted to the lower peripheral face obliquely relative to the face, by a first machining step while cutting off flash formed during the first die forging step;

forming the head piece into said head, by a second die forging step; and finishing the head by forming the part corresponding to said cavity to a final shape, by a second machining step.

14. A method of manufacturing a golfing iron club according to claim 13, wherein said first and second machining steps use an end mill as a machining tool, in which an end mill of a smaller diameter is used in said second machining step than in said first machining step.

15. A method of manufacturing a golfing iron club according to claim 14, wherein the lower peripheral face of said cavity is formed with a groove by said second machining.

16. A method of manufacturing a golfing iron club according to claim 15, wherein said groove is formed by abutting a distal end of an end mill to said cavity obliquely relative to said face.

* * * * *